US005974335A

United States Patent [19]

Talisa et al.

[11] Patent Number: 5,974,335

[45] Date of Patent: Oct. 26, 1999

[54] HIGH-TEMPERATURE SUPERCONDUCTING MICROWAVE DELAY LINE OF SPIRAL CONFIGURATION

[75] Inventors: Salvador H. Talisa, Edgewood; David J. Janocko, Forest Hills; Richard S. Nye, Ruffsdale; Stanley J. Pieseski, Trafford, all of Pa.; Daniel C. Buck, Hanover, Md.; Paul LePage, Towson, Md.; William E. McGann, Linthicum, Md.; Charles Moskowitz, Ellicott City, Md.

[73] Assignee: Northrop Grumman Corporation, Los Angeles, Calif.

[21] Appl. No.: 08/486,656

[22] Filed: Jun. 7, 1995

[51] Int. Cl.[6] ..... H01P 1/18; H01B 12/02

[52] U.S. Cl. ..... 505/210; 505/700; 505/701; 505/866; 333/99 S; 333/161

[58] Field of Search ..... 333/99 S, 161; 505/210, 700, 701, 866

[56] References Cited

U.S. PATENT DOCUMENTS

| | | | |
|---|---|---|---|
| 3,013,227 | 12/1961 | Jordan | 333/101 |
| 3,777,287 | 12/1973 | Louvel | 333/246 |
| 4,600,907 | 7/1986 | Grellman et al. | 333/246 |
| 4,675,625 | 6/1987 | Johnston | 333/161 |
| 5,164,692 | 11/1992 | Gertel et al. | 333/161 X |
| 5,258,626 | 11/1993 | Suzuki et al. | 257/39 |

FOREIGN PATENT DOCUMENTS

| | | | |
|---|---|---|---|
| 205904 | 9/1991 | Japan | 333/157 |

OTHER PUBLICATIONS

Fotontsch H A and La Fave L.E.; "Continuous Variable Electrical Delay Line"; *IBM Technical Disclosure Bulletin*; vol. 6, No. 1; Jun. 1963; pp. 64–65.

Talisa et al ; "High Temperature Superconducting Wideband Delay Lines", *Microwave Journal* ; Nov. 1995; pp. 88, 90, 93, 94, 96 ; (Effective Disclosure Date Oct. 17, 1994).

"HTS Filters and Delay Lines Suit EW Systems", by Joe Madden and Neal Fenzi, Microwaves & RF, May, 1994.

"High $T_c$ Materials Expand Superconductive Circuit Applications", by A. Davidson, J. Talvacchio, M.G. Forrester and J.R. Gavaler, Microwaves & RF, Apr., 1994.

*Primary Examiner*—Benny T. Lee

[57] ABSTRACT

A high-temperature superconductive microwave delay line that operates in an essentially pure TEM field configuration in a compact assembly. The delay line is a planar signal delay line which includes first and second substrates made of first and second dielectric materials; each substrate can be LAO material. First and second patterned delay line segments having a configuration, are formed of first and second conductive materials on the obverse sides of the first and second substrates, respectively. On the reverse side of each of the first and second substrates, respective first and second ground planes are formed using respective first and second conductive materials, which are preferred to be high-temperature superconductive films, such as YBCO films. The delay line also includes coupling means for coupling the first patterned delay line segment to the second patterned delay line segment, thus bringing the two patterned delay line segments into substantial contact.

16 Claims, 5 Drawing Sheets

HIGH-TEMPERATURE SUPERCONDUCTING MICROWAVE DELAY LINE OF SPIRAL CONFIGURATION

STATEMENT OF GOVERNMENT INTEREST

The U.S. Government has rights in this invention pursuant to a contract with the Department of Defense.

BACKGROUND OF THE INVENTION

1. Field of the Invention

This invention relates to devices for use at microwave frequencies, in particular, high-temperature superconducting devices for use at microwave frequencies and, more particularly, to high-temperature superconducting microwave delay lines.

2. Description of the Prior Art

Microwave delay lines are of interest as memory elements in radar, electronic warfare, and communications systems in order to temporarily store signals while they are being pre-processed in other parts of the system. After pre-processing, the stored signals can be properly redirected for further processing. Typically, delays on the order of about 100 to 300 ns are needed for this type of application. Currently available delay lines are typically lengths of coaxial cable with at least one amplifier section. These delay lines limit the dynamic range of the system receiver because of the amplifiers, and are physically large. Delay lines are also needed in satellite communications transponders, where memory storage of signals is required while switching to appropriate channels occurs. Microwave delay lines can be fabricated using a number of planar configurations including the microstrip line structure, the coplanar line structure, and the stripline structure. Although it is important to provide as much delay, i.e., delay line length, as is reasonably possible in an area as small as possible, it also is important that crosstalk does not occur between adjacent delay line segments of the same delay line.

In a pure TEM structure, the even and odd phase velocities of adjacent, parallel coupled lines are the same. Only backward coupling can take place, and this can be controlled by adjusting the distance between the delay lines because it is periodic in the length of the coupler from zero to a maximum determined by the distance between the lines. Microstrip line has unequal, even and odd phase velocities which result in both backward and forward coupling between parallel lines. This is more difficult to control because forward coupling is cumulative with line length. A substantially complete transfer of energy is possible if two loosely coupled lines run parallel to each other for a sufficiently long distance. A coplanar line structure has an inherent shielding between adjacent lines, and, therefore, allows better isolation between these lines. However, it requires that the ground planes be equalized with periodic crossovers which bridge over the signal carrying line. The use of crossovers increases insertion losses and, because they typically are fabricated with gold ribbons, can make fabrication costly.

Some superconducting stripline delay lines have been fabricated for analog signal processing purposes. However, these delay lines were in the form of dispersive delay lines. The delay lines subject of this invention are non-dispersive, i.e., they have constant delay versus frequency over a wide bandwidth, typically 2 GHz or more. Others have fabricated high-temperature superconductive non-dispersive stripline delay lines with a spiral configuration but have not provided composite delay line structures as provided in the invention herein.

What is needed then is a high-temperature superconductive microwave delay line that operates in an essentially pure TEM field configuration in a compact assembly.

SUMMARY OF THE INVENTION

The invention herein provides a high-temperature superconductive microwave delay line that operates in an essentially pure TEM field configuration in a compact assembly. The delay line is a planar signal delay line which includes a first substrate made of a first preselected dielectric material and a second substrate made of a second preselected dielectric material. A first patterned delay line segment having a predefined configuration, a first predefined length, and a first predefined line width, is formed of a first preselected conductive material on the obverse side of the first substrate. Similarly, a patterned delay line segment having a predefined configuration, a second predefined length, and a second predefined line width, is formed of a second preselected conductive material on the obverse side of the second substrate. On the reverse side of each of the first and second substrates, respective first and second ground planes are formed using respective first and second preselected conductive materials, which are preferred to be high-temperature superconductive films.

The delay line also includes coupling means for coupling the first patterned delay line segment to the second patterned delay line segment, thus bringing the two patterned delay line segments into substantial contact. Coupling means can include retaining means for retaining the obverse side of the first substrate upon the obverse side of the second substrate such that the first patterned delay line segment is in substantial contact with the second patterned delay line segment. The retaining means includes a biasing assembly having at least one fastener and at least one biasing means, with biasing means cooperating with the fastener to bring the first patterned delay line segment into selectable forcible contact with the second patterned delay line segment.

Furthermore, the coupling means can include a carrier assembly having a top portion affixed to the first substrate and a bottom portion affixed to the second substrate, with each of the top and bottom portions being made of a third preselected conductive material. The coupling means also includes aligning means for aligning the first substrate with the second substrate, and the first patterned delay line segment with the second patterned delay line segment. The aligning means includes a first alignment indicium on the first substrate, the second substrate, or both, and a second alignment indicium on the first substrate, the second substrate, or both, with the first alignment indicium being alignable with the second alignment indicium. The aligning means further includes an alignment pin on one of the top and bottom portions of the carrier assembly and an alignment slot on the other of the top and bottom portions, with the alignment pin being matable with the alignment slot.

In one embodiment of the present invention it is preferred that the high-temperature superconductive material is YBCO (yltrium barium copper oxide), and that the first and second preselected dielectric material is LAO (lanthanum aluminum oxide). It is preferred that the first and second predefined line width be about 150 microns, and that the first and second predefined length be about five centimeters. It is further preferred that the third preselected conductive material be one of niobium, vanadium, tantalum, an aluminum-silicon-carbide ceramic composite material, and a low-temperature-cofired ceramic composite material.

In one embodiment of the present invention, the predefined configuration is preferred to be a double-wound spiral configuration. In another embodiment, the predefined configuration is preferred to be a meander configuration. In general, it is preferred that the first predefined length is approximately equal to the second predefined length, and that such lengths are each about 1.5 meters. Also, in one embodiment, it is preferred that an input includes a first coplanar transmission line input region and an the output includes a first coplanar transmission line output region.

The first patterned delay line segment can include a first input transformer connected to the input and a first output transformer connected to the output; the second patterned delay line segment can also include, if desired, a second input transformer and a second output transformer. It is preferred that the first input transformer and the first output transformer have a predefined transformation ratio, a predefined length and a predefined configuration. Similarly, it is preferred that the second output transformer has a second predefined transformation ratio, a second predefined length, and a second predefined configuration. The first and second transformation ratios can be approximately equal and, in one embodiment, are preferred to each be about 50 ohms to 27 ohms. For each transformer, the first and second predefined configurations each have a tapered line width having a wide portion and a narrow portion, with the narrow portion being connectable with respective ones of the input and the output.

The invention herein also includes a method for providing a composite planar signal delay line which consists of providing a first ground plane by forming a first conductive film on the reverse side of a first substrate; providing a first delay line segment by forming a second conductive film with a first predetermined pattern on the obverse side of the first substrate; affixing the reverse side of the first substrate to a first electrically-conductive carrier; providing a second ground plane by forming a third conductive film on the reverse side of a second substrate; providing a second delay line segment by forming a fourth conductive film with a second predetermined pattern on the obverse side of the second substrate; affixing the reverse side of the second substrate to a second electrically-conductive carrier; aligning the first substrate with the second substrate and the first delay line segment with the second delay line segment so that the first delay line segment is in substantial contact with the second delay line segment; coupling the first carrier to the second carrier to maintain the substantial contact between the first delay line segment and the second delay line segment; electrically connecting one end of the first delay line segment to the input, and the other end, to the output to produce the composite planar signal delay line thereby.

The method can further include the steps of forming an impedance transformer on each end of each of the first and second delay line segments, each of the transformers having a predefined impedance value; forming coplanar transition regions, between the input and one end, and between the output and the other end of the first delay line segment. It is preferred that the first, second, third, and fourth conductive films are a high-temperature superconductive film. It is further preferred that the high-temperature superconductive film is a YBCO film and the first and second substrate are an LAO substrate and, in particular, that the YBCO film is $YBa_2Cu_3O_7$ and the LAO substrate is $LaAlO_3$.

In one embodiment, each of the first and second predetermined patterns is a spiral pattern, and can be a double-wound spiral pattern. In another embodiment, each of the first and second predetermined patterns is a meander pattern.

DETAILED DESCRIPTION OF THE PREFERRED EMBODIMENTS

Figure 1:
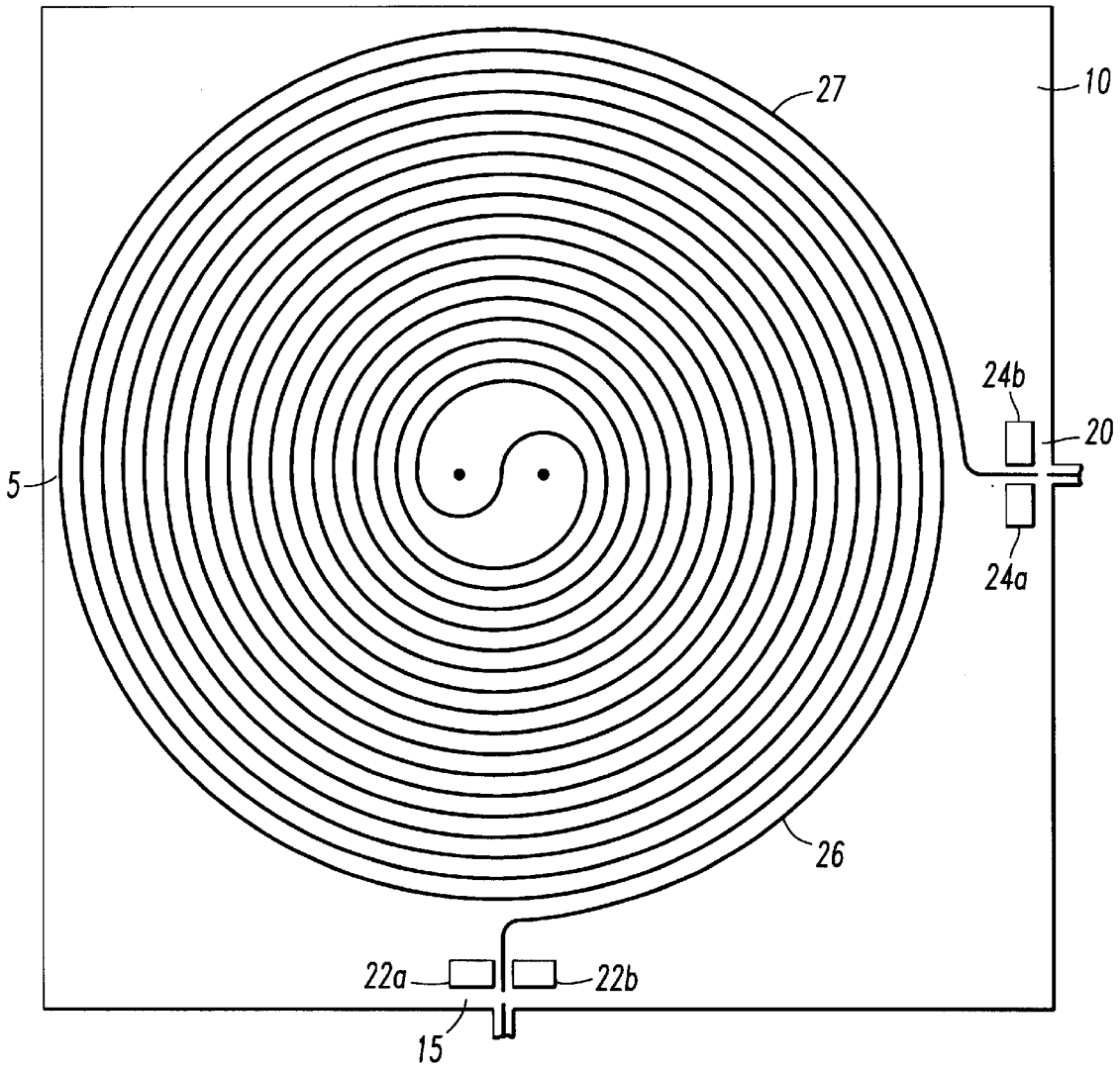
FIG. 1 is a plan view illustration of a double-wound spiral delay line segment formed on one side of one substrate according to the invention herein.

In the drawings, like or corresponding parts are denoted by like or corresponding reference numerals.

The invention herein provides for a high-temperature superconducting, wide-band, low-loss, non-dispersive microwave delay line and method for manufacturing the high-temperature superconductive (HTS) microwave delay line. The delay line can have a length of stripline-type transmission line composed of two dielectric substrates, on both sides of which high-temperature superconductor films have been deposited. The HTS film on one side of each of the dielectric substrates is generally patterned, and can be in the form of a double-wound spiral strip or a meander. The lines patterned on the two substrates are preferred to be mirror images of each other. The delay line then can be assembled by positioning each of the substrates with respect to the other such that the mirror image stripline patterns which exist on the two substrate surfaces are juxtaposed, aligned and in contact. In general, the structure including the innermost juxtaposed strips, the substrate dielectric, and the outermost ground plane films form the stripline assembly.

An advantage of the stripline structure over other planar geometries, such as, for example, microstrip structures or coplanar line structures, is that stripline structures can have an essentially pure TEM field configuration in an enclosed region filled with dielectric, i.e., the top and bottom substrates. Because of this essentially pure TEM structure, the even and odd phase velocities of adjacent parallel line segments of the patterned delay line can be the same and, therefore, the disadvantages of forward coupling between those parallel line segments can be substantially reduced. Because the mode of coupling is primarily backward coupling, the magnitude of the coupling can be controlled by adjusting the distance between adjacent parallel line segments. This consideration can determine the total patterned line length for a given substrate area.

The delay line according to the invention herein can include at least two segments each having a long length of patterned line. This line may be about 1.5 meters or longer when using 10-mil thick substrates. To provide a 50 ohm delay line on a 10-mil thick LAO substrate, a narrow line width of approximately 22 $\mu$m may be used. However, fabrication of such a long length of uninterrupted, relatively narrow line can be difficult to fabricate uniformly and reliably. In order to reduce the effect of film or fabrication defects, a line that is significantly wider than a 50-ohm line can be used. In addition, a wide line also can reduce the impact of misalignments between the contacting delay line segments. Indeed, misalignment can result in a wider equivalent delay line.

When delay lines have a characteristic of about 50 ohms, the rate of change of impedance with respect to line width can be greater than the characteristic impedance of a wide line at, for example, 25 ohms. In general, the robustness of the design can be improved with respect to delay line fabrication and line alignment by the use of lower impedance and wider line width. For example, a delay line that is 150 micrometers wide on a 10-mil-thick LAO substrate can provide a characteristic impedance of approximately 27 ohms. To provide a 50-ohm impedance with respect to input and output connections, tapered impedance transformers can be used at both ends of the patterned delay line segment. Therefore, each of such transformers can have a predefined transformation ratio of, as in this case, about 50 ohms to about 27 ohms. The lowest frequency at which these transformers can perform satisfactorily can be determined by the length of the taper. For example, tapers that are approximately 2 cm in length can produce satisfactory performance above about 1.5 GHz; a taper length of approximately 4 cm can provide satisfactory performance in the frequency range of above about 0.5 GHz.

Figure 1A:
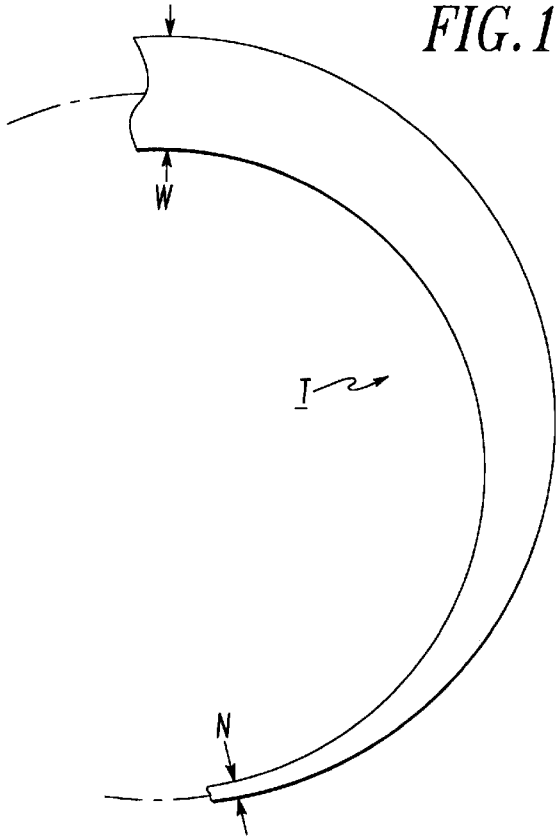
FIG. 1*a* is a view of a tapered transformer at the end of a delay line segment.

FIG. 1 illustrates one such patterned delay line segment 5 formed on the obverse side of one layer of substrate 10. In one present embodiment, it is preferred that the patterned delay line segment be a double-wound spiral configuration, as shown in FIG. 1. Patterned delay line segment 5 can be made of YBCO (e.g., $YBa_2Cu_3O_7$) HTS film; substrate 10 can be made of LAO (i.e., $LaAlO_3$) material. To provide a 50-ohm terminal impedance, impedance transformers 26, 27 can be connected to input 15 and output 20, respectively. Patterned delay line segment 5 can have a predefined length and a predefined line width from transformer 26 to transformer 27. By way of example, as further illustrated in FIG. 1*a* (not to scale) for each transformer, generically represented by reference character T, the predefined configurations each have a tapered line width having a wide portion W, matching that of the deposited delay line and which tapers down to a narrow portion N, which is connected to a signal input or output. Input 15 and output 20 of each spiral line segment can be provided with coplanar line transition input and output pad pairs 22*a*, 22*b* and 24*a*, 24*b*, respectively.

Figure 2:
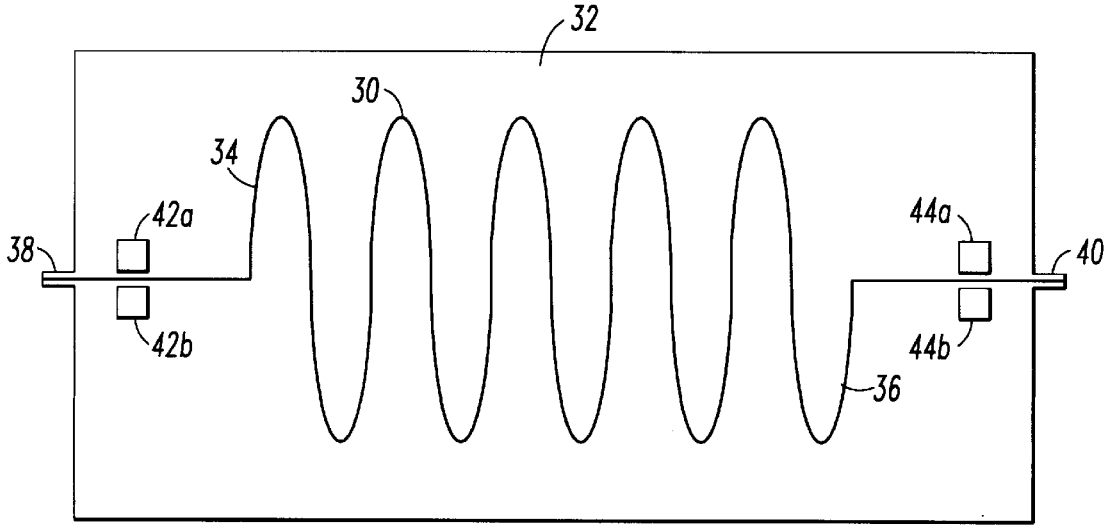
FIG. 2 is a plan view illustration of a meander-configuration delay line segment formed on one side of one substrate according to the invention herein.

In another present embodiment, it is preferred that the patterned delay line segment be a meander configuration, as shown in FIG. 2. Similar to FIG. 1, patterned delay line segment 30 can be formed on the obverse side of one layer of substrate 32. Patterned delay line segment 30 can be made of YBCO (e.g., $YBa_2Cu_3O_7$) HTS film; substrate 32 can be made of LAO (i.e., $LaAlO_3$) material. To provide a 50 ohm terminal impedance, impedance transformers 34, 36 can be connected to input 38 and output 40, respectively. Patterned delay line segment 30 can have a predefined length and a predefined width from transformer 34 to transformer 36. Input 38 and output 40 can be provided with coplanar line transition input and output pad pairs 42*a*, 42*b* and 44*a*, 44*b*, respectively. In addition to the double-wound spiral and meander configurations of FIGS. 1 and 2, respectively, other patterned delay line segment configurations also may be employed, in particular, configurations capable of providing long line segment lengths that are amenable to mirror-image line segment assemblies.

Figure 3:
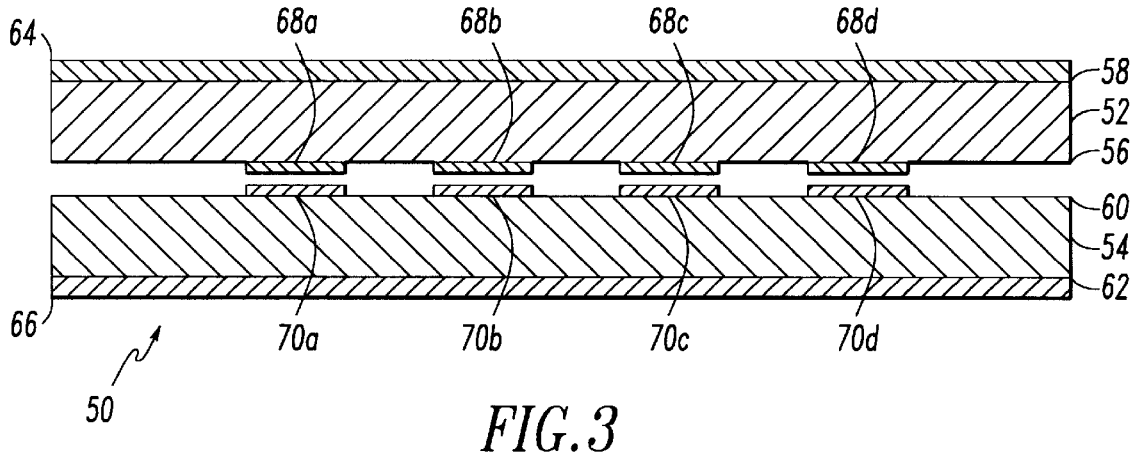
FIG. 3 is a sectional view illustration of one embodiment of the composite delay line according to the invention herein.

In order to provide a delay line assembly that is an essentially pure TEM mode stripline assembly, mirror-image patterns can be provided on the contacting surfaces of two substrates. FIG. 3 illustrates a sectional view of planar signal delay line 50 having first substrate 52 and second substrate 54. Substrate 52 can have an obverse side 56 and a reverse side 58. Similarly, substrate 54 can have an obverse side 60 and a reverse side 62. On reverse sides 58, 62 of each of the respective substrates 52, 54 can be formed ground planes 64, 66 using a layer of preselected conductive material, particularly high-temperature superconducting film, both of which can be YBCO HTS film. On obverse sides 56, 60 of each of the respective substrates 52, 54 can be formed patterned delay line segments, as seen in FIGS. 1 and 2. Owing to the sectional nature of FIG. 3, however, the first patterned delay line segment can be represented by first patterned delay line sections 68*a*, 68*b*, 68*c*, 68*d* and the second patterned delay line segment can be represented by second delay line sections 70*a*, 70*b*, 70*c*, 70*d*. It is preferred that substrates 52, 54 each be composed of a preselected dielectric material such as, for example, LAO.

If both substrates were perfectly flat or could be contacted without air gaps, a patterned delay line segment on only one of substrates 52, 54 may suffice. However, small air gaps often can exist between the juxtaposed substrate surfaces, especially when using the large area substrates and long lines used for practical delay times. Such air gaps can result in inhomogeneities in the effective dielectric constant which, in turn, can result in unequal even and odd phase velocities, thus fostering forward coupling and degrading the delay line electrical performance. With the mirror-image patterns provided on each of substrates 52, 54, the two delay line segments, as represented by sections 68*a*, 68*b*, 68*c*, 68*d*, 70*a*, 70*b*, 70*c*, 70*d*, can be made to be in contact periodically, thereby substantially equalizing the electromagnetic propagation in both substrates 52, 54. To provide the desired total delay, the first delay line segment, as represented by sections 68*a*, 68*b*, 68*c*, 68*d* can be operably connected to the second delay line segment, as represented by sections 70*a*, 70*b*, 70*c*, 70*d*, thus providing a composite planar signal delay line. Additional composite delay lines may be connected together to provide for even greater total delays.

Figure 4A:
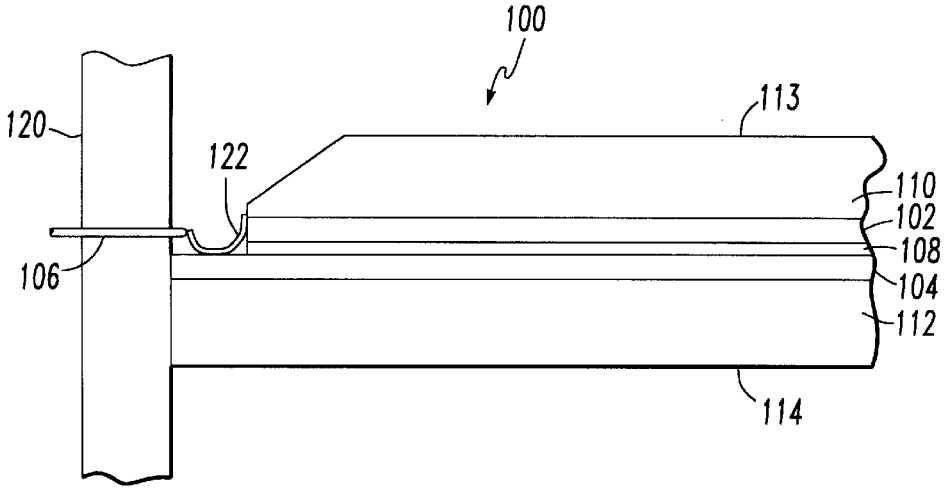
FIG. 4*a* is a sectional view illustration of a portion of a composite delay line showing a coaxial connection.
Figure 4B:
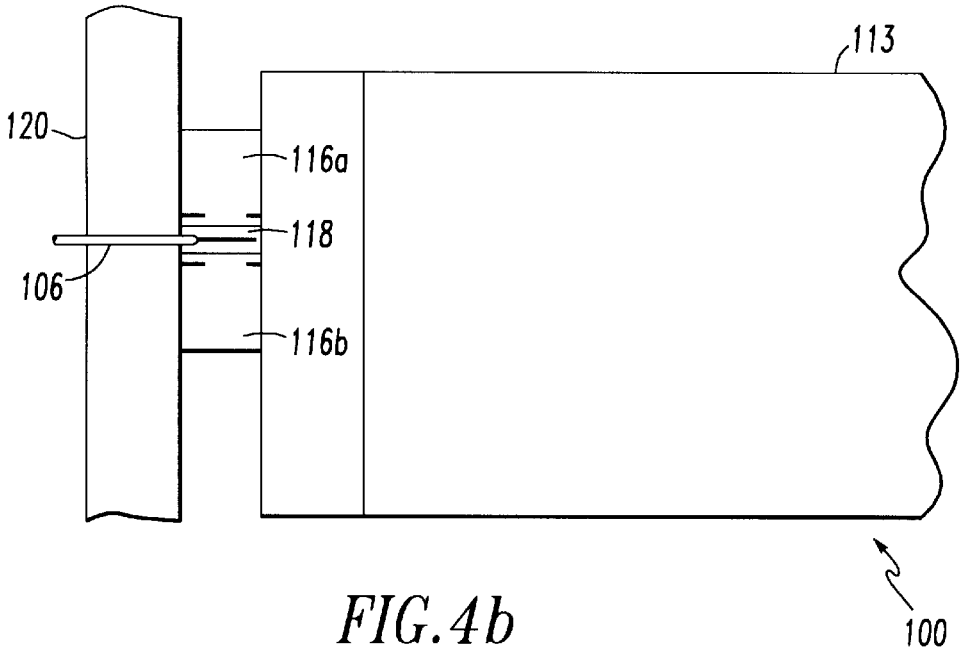
FIG. 4*b* is a plan view illustration of the portion in FIG. 4*a* showing coplanar transition region pads.

It can be desirable that the currents on both top and bottom ground planes of the stripline composite delay line be excited generally in phase. This can be accomplished by having a short, 50-ohm coplanar line transition region between coaxial connectors and the stripline region. FIG. 4*a* is a sectional view of an edge of the delay line structure 100 according to the invention herein. FIG. 4*b* is a plan view of the portion of delay line 100 shown in FIG. 4*a*. In FIG. 4*a*, first substrate 102 can be seen positioned above second substrate 104. In addition, on the reverse sides of substrates 102, 104 can be seen ground planes 110, 112, respectively contacted by a top carrier 113 and a bottom carrier 114 of a coupling means. Coaxial connectors such as coaxial connector 106, passing through package wall 120, can be used on both the input and the output of the delay line 108 to provide compatibility with microwave components. In FIG. 4*b*, the coplanar line transition region, for example, pads 116*a*, 116*b*, are visible. In this view, top carrier 113 generally obstructs the view of the components below. Coplanar line transition region pads 116*a*, 116*b* can have a back ground plane 112 on the bottom of lower substrate 104 as seen in FIG. 4*a*. The distance from pads 116*a*, 116*b* to center strip 118 of the section is sufficiently large so that center strip 118 is approximately as wide as a 50-ohm microstrip line. Also, when considered as a coplanar line, the spacing of center strip 118 from pads 116*a*, 116*b* can be sufficient to maintain a 50-ohm impedance.

The purpose of the coplanar transition region at pads 116*a*, 116*b* is to excite ground currents on the lower ground plane 112, similar to that of a microstrip line, and to use the pads 116*a*, 116*b* for a direct connection between the package wall 120 and the back ground plane 110 of the upper substrate 102, using gold ribbon 122 as seen in FIG. 4*a*. This direct connection can allow the excitation of ground currents in ground plane 110 to be approximately in phase with the ground currents in ground plane 112. In-phase excitation of ground plane currents is desirable for wide-band operation of the delay line. For example, for 10-mil-thick LAO substrates, center strip 118 can be about 88 $\mu$m wide, and pads 116*a*, 116*b* can be separated by about 400 $\mu$m from center strip 118. A strip width of 88 $\mu$m is preferred to maintain a 50-ohms microstrip characteristic impedance.

Coupling means for coupling the first patterned delay line segment to the second patterned delay line segment can be provided so that the two patterned delay line segments are substantially in contact with each other. Such coupling means can include means for aligning the first substrate with the second substrate and the first patterned delay line segment with the second patterned delay line segment, because it can be desirable to maintain accurate registration between the two patterns. Aligning means for aligning the first substrate with the second substrate, and the first delay line segment with the second delay line segment, can be employed to provide and maintain accurate registration.

Figure 5:
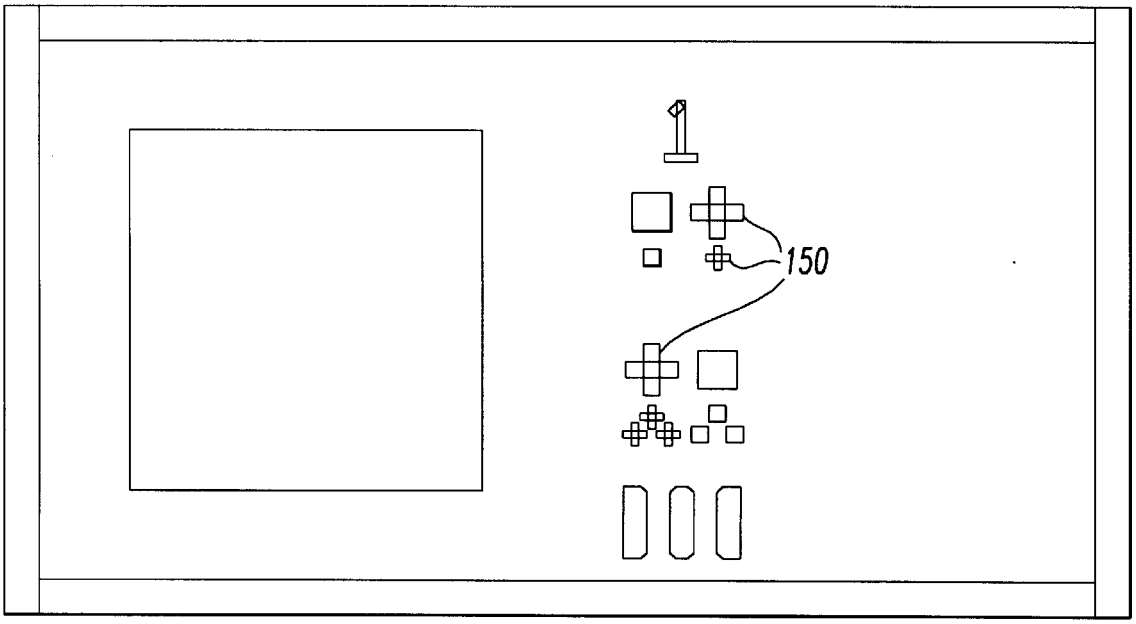
FIG. 5 is an illustration of the aligning means showing fiducial markings which may be viewed through registration holes.

As seen in FIG. 5, such aligning means can include a plurality of fiducial marks 150 that can be defined on the obverse sides of the first and second substrates at the time the device is fabricated. It is preferred that fiducial marks 150 be defined photolithographically. Fiducial marks 150 on each of the first and second substrates are defined such that fiducial marks 150 on the first substrate generally are mirror-images of fiducial marks 150 on the second substrate, thus enhancing the alignment of the two contacting surfaces.

To allow for fiducial marks 150 to be viewed for alignment, small holes, (not shown) also included in the aligning means, can be provided in the ground plane layer of the upper substrate. It is preferred that the aforementioned holes be produced photolithographically. It is desired that these holes be substantially in registration with fiducial marks 150 on the front side of the substrate. Making holes in the substrate carriers can allow an unobstructed view of fiducial marks 150 through the substrate for proper alignment to be accomplished. Fiducial marks 150 can be observed because many HTS substrates are transparent in the visible wavelength range. An alignment fixture may be used to allow rotation and translation of one of the substrate-carrier assemblies. Pressure can be maintained to keep the substrates in good contact.

In addition to the aforementioned aligning means, the coupling means can also include retaining means for retaining the obverse side of the first substrate upon the obverse side of the second substrate such that the first patterned line segment is substantially in contact with the second patterned line segment, thus forming a composite delay line. The retaining means can include a carrier assembly in which each of the two carriers are affixed to a respective substrate. The retaining means can also include a biasing assembly for maintaining the first and second substrates in alignment and the first and second patterned line segments in forcible contact.

Figure 6:
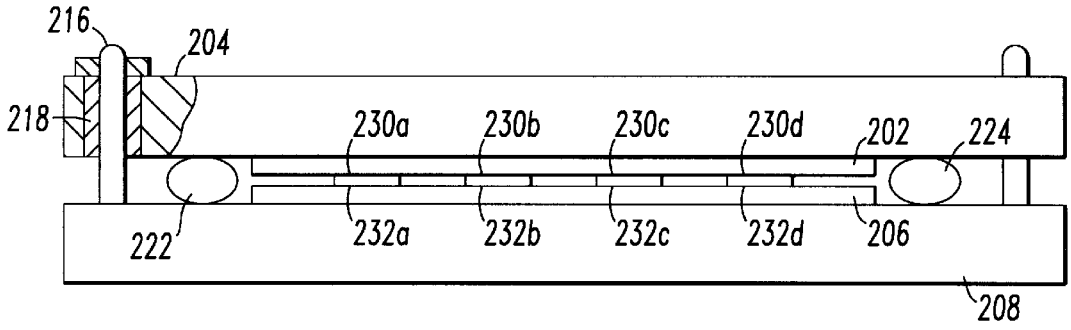
FIG. 6 is a sectional view of a composite delay line including retaining means.

In retaining means 200, seen in FIG. 6, first substrate 202 can be affixed to top carrier 204 which is preferred to be a conductive material that can match the contraction of LAO when cooling a substrate to 77° K., the operating temperature, such as niobium, Group 5A metals, and some special non-conducting ceramic composition which can be coated with an electrically conducting layer such as, for example, an aluminum-silicon carbide-ceramic composite. Low-temperature co-fired ceramic composites also can be used. Likewise, second substrate 206 can be affixed to a similarly-composed bottom carrier 208.

Substrates 202, 206 can be respectively affixed to carriers 204, 208 using, for example, thin indium metal sheets. Top and bottom substrates 202, 206 can be independently attached to carriers 204, 208, respectively. The stripline assembly can then be made by joining the two LAO surfaces of substrate 202, 206, and aligning them as described above. Retaining means 200 acting as the carrier assembly, in itself, is the electrical enclosure of the delay line. Retaining means 200 then can be snapped into a frame containing the coaxial connectors using springs attached to the frame. Because of the actions of the spring, retaining means 200 can be made of a material other than niobium, such as, for example, aluminum, without substantial electrical or mechanical degradation.

Once proper alignment is achieved, vertical contact pressure can be established by a biasing assembly which can draw together bottom carrier 204 and top carrier 208. The biasing assembly can include at least one fastener which can have a nut 212 mated on pin 216 threaded on both ends and screwed onto bottom carrier 208 through clearance holes, such as 218, in top carrier 204. Pins such as 216 then can be held in horizontal alignment by filling clearance holes, such as 218, with low-melting-point fusible alloy, or epoxy, injected between pin 216 and the wall of clearance hole 218. Biasing means including spiral spring washers 222, 224 can ensure proper electrical contact between top and bottom carriers 204, 208 at the edge of the substrates 202, 206. This can provide a controlled electrical enclosure of the smallest possible area, i.e., approximately that of the substrates used. This feature also permits a composite planar signal delay line provided according to the invention herein to be used as a module for larger delay lines comprising several units. Biasing means can also include a conical belville spring washer (not shown) that can be provided between nut 212 and carrier 204 to enhance the action of the fastener.

The overall enclosure formed by retaining means 200 can mechanically support the composite assembly and the input/output connectors, and can also include a biasing means which cooperates with the fastener to bring the first delay line segment into forcible contact with the second delay line segment. The compression resistance of spiral spring washers 222, 224 can be overcome by tightening of at least one of the four alignment pin nuts, such as 212, to bring the substrate surfaces, i.e., delay line segments as represented by sections 230*a*, 230 *b*, 230*c*, 230*d* and 232*a*, 232 *b*, 232*c*, 232*d* into contact. The point at which substrate contact occurs can be seen by observing the relative focus position of the superimposed alignment marks using a suitable microscope.

EXAMPLE

A planar signal delay line according to the invention herein was fabricated using $YBa_2Cu_3O_7$ as the HTS film and LAO as the substrate. The LAO substrates used were about 10 mils thick. The delay line spirals broadened to a width of about 150 microns, giving a 27-ohm characteristic impedance. The impedance transformers were about 5 cm long on each end of each spiral and were tapered from about 150 microns linewidth to about 22 microns linewidth, yielding a 50-ohm characteristic impedance at the input and output of the delay line. Because the spiral length is approximately 1.5 meters long, the corresponding delay was measured to be about 22.5 nanoseconds.

Figure 7:
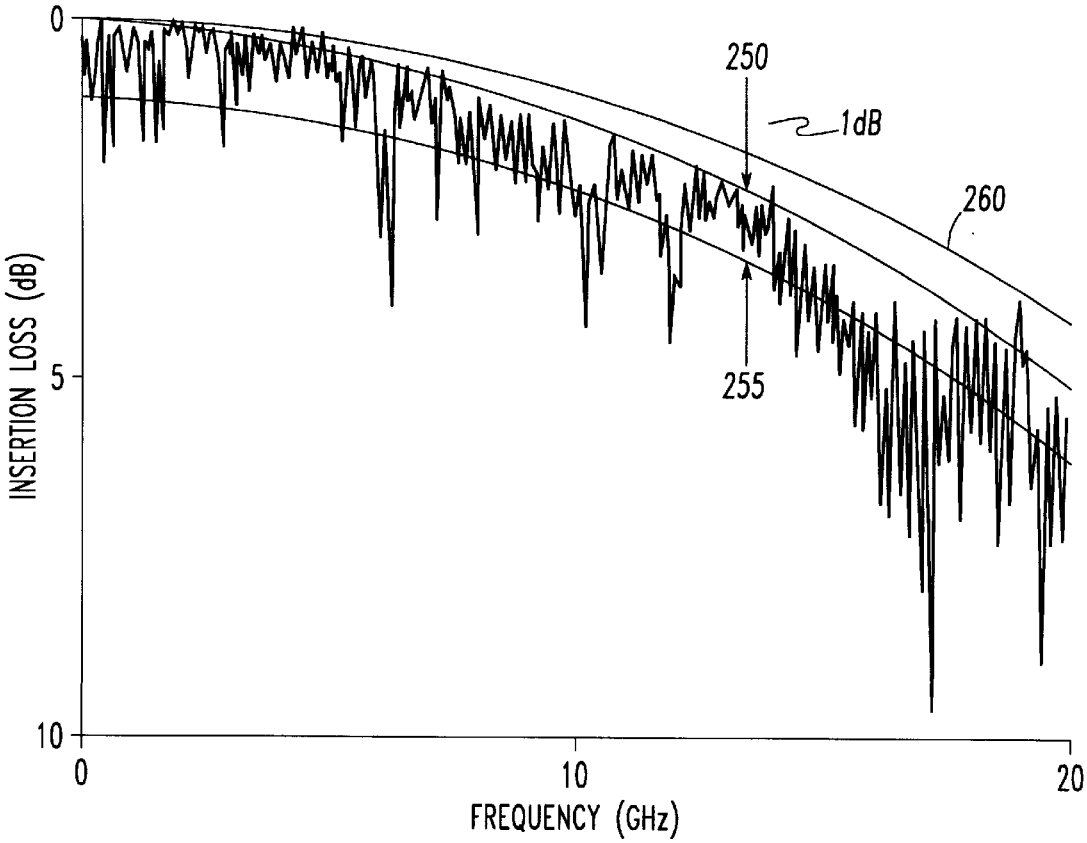
FIG. 7 is a graph of the amplitude response of an example composite delay line according to the invention herein.

FIG. 7 shows the amplitude response of this sample delay line at 77° K. between about 45 MHz and about 20 GHz. Solid line 260 indicates the projected optimum insertion loss expected to be obtained when all films, i.e., the spirals and the ground planes, have a surface resistance of 0.5 milliohm at 10 GHz and 77° K. The actual measurements shown in FIG. 7 have an amplitude ripple of within about 1 dB, the 1 dB range being indicated by the section between arrows 250 and 255 over most of the band, indicating satisfactory performance.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the invention which is to be given the full breadth of the following claims and any and all embodiments thereof.

We claim:

1. A planar signal delay line having a signal input and a signal output, comprising:

(a) a first substrate comprised of a first preselected dielectric material and having an obverse side and a reverse side;

(b) a first patterned delay line segment having a predefined configuration, a first predefined length, and a first predefined line width, said first patterned delay line segment being comprised of a first preselected conductive material and being disposed on said obverse side of said first substrate, one end of said patterned delay line segment being connected to said input and another end thereof being connected to said output;

(c) a first ground plane being comprised of said first preselected conductive material and being disposed on said reverse side of said first substrate;

(d) a second substrate comprised of a second preselected dielectric material, and having an obverse side and a reverse side;

(e) a second patterned delay line segment having a predefined configuration which substantially matches the predetermined configuration of said first patterned delay line segment, a second predefined length, and a second predefined line width, said second patterned delay line segment being comprised of a second preselected conductive material and disposed on said obverse side of said second substrate, said first patterned delay line segment being in registration with said second patterned delay line segment;

(f) a second ground plane being comprised of said second preselected conductive material and being disposed on said reverse side of said second substrate;

(g) coupling means, including a carrier assembly having a top portion and a bottom portion, for coupling said first patterned delay line segment to said second patterned delay line segment, said first patterned delay line segment being in substantial physical and electrical contact with said second patterned delay line segment;

(h) at least said first patterned delay line segment including respective first and second transformers at said respective ends thereof, said transformers having respective first and second predefined transformation ratios, and each transformer being tapered from a relatively wide width matching said first predefined line width to a relatively narrow width at said input and said output, respectively;

(i) said coupling means additionally including means for aligning said first substrate with said second substrate and said first patterned delay line segment with said second patterned delay line segment, respectively;

(j) said means for aligning including at least one first alignment indicium on at least one of said first substrate and said second substrate and at least one second alignment indicium on at least one of said first substrate and said second substrate, said at least one first alignment indicium being alignable with said at least one second alignment indicium, respectively; and (k) wherein said aligning means further includes an alignment pin on one of said top portion and said bottom portion of said carrier assembly and an alignment slot on the other of said top portion and said bottom portion, said alignment pin being mated with said alignment slot.

2. The planar signal delay line of claim 1 wherein each said first and second preselected conductive material is a respective high-temperature superconductive material.

3. The planar signal delay line of claim 2 wherein each said respective high-temperature superconductive material is YBCO.

4. The planar signal delay line of claim 1 wherein each said first and second preselected dielectric material is LAO.

5. The planar signal delay line of claim 1 wherein the configuration of each said first and second patterned delay line segment is a meander stripline.

6. The planar signal delay line of claim 1 wherein the configuration of each said first and second patterned delay line segment is a meander line.

7. The planar signal delay line of claim 1 wherein each said first and second predefined line width is about 150 microns.

8. The planar signal delay line of claim 1 wherein said first input includes a first coplanar transmission line input region and said first output includes a first coplanar transmission line output region.

9. The planar signal delay line of claim 1 wherein the configuration of each said first and second patterned delay line segment is a spiral stripline.

10. The planar signal delay line of claim 1 wherein said first predefined transformation ratio is approximately equal to said second predefined transformation ratio.

11. The planar signal delay line of claim 10 wherein each of said first and second predefined transformation ratios is respectively in the range between 50 ohms to 27 ohms.

12. The planar signal delay line of claim 11 wherein each said first and second predefined length is about five centimeters.

13. The planar signal delay line of claim 1, wherein said first predefined length is approximately equal to said second predefined length.

14. The planar signal delay line of claim 13, wherein said first and second predefined lengths are each about 1.5 meters.

15. A planar signal delay line having a signal input and a signal output, comprising:

(a) a first substrate comprised of a first preselected dielectric material and having an obverse side and a reverse side;

(b) a first patterned delay line segment having a predefined configuration, a first predefined length, and a first predefined line width, said first patterned delay line segment being comprised of a first preselected conductive material and being disposed on said obverse side of said first substrate, one end of said patterned delay line segment being connected to said input and another end thereof being connected to said output;

(c) a first ground plane being comprised of said first preselected conductive material and being disposed on said reverse side of said first substrate;

(d) a second substrate comprised of a second preselected dielectric material, and having an obverse side and a reverse side;

(e) a second patterned delay line segment having a predefined configuration which substantially matches the predetermined configuration of said first patterned delay line segment, a second predefined length, and a second predefined line width, said second patterned delay line segment being comprised of a second preselected conductive material and disposed on said obverse side of said second substrate, said first patterned delay line segment being in registration with said second patterned delay line segment;

(f) a second ground plane being comprised of said second preselected conductive material and being disposed on said reverse side of said second substrate;

(g) coupling means for coupling said first patterned delay line segment to said second patterned delay line segment, said first patterned delay line segment being in substantial physical and electrical contact with said second patterned delay line segment;

(h) at least said first patterned delay line segment including respective first and second transformers at said respective ends thereof, said transformers having respective first and second predefined transformation ratios, and each, transformer being tapered from a relatively wide width matching said first predefined line width to a relatively narrow width at said input and said output, respectively; and (i) wherein the configuration of each said first and second patterned delay line segment is a double-wound spiral.

16. The planar signal delay line of claim 15 wherein said double-wound spiral configuration is a stripline double-wound spiral configuration.

* * * * *